US010334926B2

(12) United States Patent
Selvi

(10) Patent No.: US 10,334,926 B2
(45) Date of Patent: Jul. 2, 2019

(54) LUGGAGE CONSTRUCTION

(71) Applicant: it Luggage Limited, Harlow, Essex (GB)

(72) Inventor: Sedat Selvi, London (GB)

(73) Assignee: it Luggage Limited, Harlow, Essex (GB)

( * ) Notice: Subject to any disclaimer, the term of this patent is extended or adjusted under 35 U.S.C. 154(b) by 0 days.

(21) Appl. No.: 14/963,673

(22) Filed: Dec. 9, 2015

(65) Prior Publication Data

US 2016/0088915 A1 Mar. 31, 2016

Related U.S. Application Data

(63) Continuation of application No. 12/373,990, filed as application No. PCT/GB2007/002644 on Jul. 13, 2007, now Pat. No. 9,220,326.

(30) Foreign Application Priority Data

Jul. 17, 2006 (GB) ..... 0614144.4
Jul. 17, 2006 (GB) ..... 0614145.1

(51) Int. Cl.
*A45C 13/04* (2006.01)
*A45C 13/26* (2006.01)
*A45C 5/14* (2006.01)

(52) U.S. Cl.
CPC ..... *A45C 13/262* (2013.01); *A45C 5/14* (2013.01); *A45C 13/04* (2013.01); *A45C 2013/267* (2013.01)

(58) Field of Classification Search
CPC ..... A45C 5/14; A45C 13/262; A45C 5/146; A45C 13/385; A45C 3/004
(Continued)

(56) References Cited

U.S. PATENT DOCUMENTS 2,729,460 A 1/1956 Forman
4,261,447 A * 4/1981 Arias ..... A45C 5/14 16/113.1
(Continued)

FOREIGN PATENT DOCUMENTS

DE 20208648 U1 10/2003
FR 2752207 2/1998
(Continued)

OTHER PUBLICATIONS

Great Britain Examination Report for GB0614144.4; dated Dec. 3, 2008.
(Continued)

*Primary Examiner* — Fenn C Mathew
*Assistant Examiner* — Cynthia F Collado
(74) *Attorney, Agent, or Firm* — Barnes & Thornburg LLP

(57) ABSTRACT

An article of luggage, such as a trolley suitcase, comprises a shape defining framework. The article of luggage may comprise a shape defining framework and a towing handle telescopically incorporated into the shape defining framework. The shape defining framework may be formed from a plurality of elongate members interconnected at their end regions by connection pieces. At least one wheel can be positioned on the shape defining framework such that when the article of luggage is moved from a standing position to a towing position, the wheel(s) enables the article of luggage to roll along the ground in the direction it is being towed.

9 Claims, 6 Drawing Sheets

(58) Field of Classification Search
USPC ..... 190/18 A, 18 R, 26, 107, 115; 280/655.1; 248/98
See application file for complete search history.

(56) References Cited

U.S. PATENT DOCUMENTS

| | | | | | |
|---|---|---|---|---|---|
| 4,813,520 | A | | 3/1989 | Lin | |
| 5,172,795 | A | * | 12/1992 | Riceman | A45C 13/002 150/105 |
| 5,181,590 | A | | 1/1993 | Carpenter et al. | |
| 5,529,156 | A | | 6/1996 | Yang | |
| 5,553,350 | A | * | 9/1996 | Chang | A45C 13/262 16/113.1 |
| 5,607,129 | A | * | 3/1997 | Kim | A45C 3/004 190/122 |
| 5,833,039 | A | * | 11/1998 | Kotkins, Jr. | A45C 3/001 190/115 |
| 6,119,835 | A | | 9/2000 | Lin | |
| 6,131,713 | A | * | 10/2000 | Sher | A45C 5/02 190/115 |
| 6,283,261 | B1 | * | 9/2001 | Sher | A45C 5/14 190/122 |
| 6,315,143 | B1 | * | 11/2001 | Dotts | B65F 1/1415 220/6 |
| 6,964,420 | B1 | | 11/2005 | Ghanizadeh et al. | |
| 7,748,508 | B2 | | 7/2010 | Lee et al. | |
| 8,118,145 | B1 | | 2/2012 | Hamamy et al. | |
| 8,517,400 | B2 | | 8/2013 | Kim | |
| 8,662,268 | B2 | * | 3/2014 | Keir | A45C 5/14 190/39 |
| 8,727,083 | B2 | | 5/2014 | Lai | |
| 9,220,326 | B2 | | 12/2015 | Selvi | |
| 9,763,503 | B2 | * | 9/2017 | Selvi | A45C 13/262 |
| 2003/0213821 | A1 | | 11/2003 | Oh | |
| 2004/0007433 | A1 | | 1/2004 | Godshaw et al. | |
| 2009/0242344 | A1 | | 10/2009 | Selvi | |
| 2012/0024649 | A1 | * | 2/2012 | Lai | A45C 5/02 190/24 |

FOREIGN PATENT DOCUMENTS

| | | | | |
|---|---|---|---|---|
| GB | 2361692 | * | 10/2001 | A45C 5/14 |
| WO | 00/13543 | | 3/2000 | |
| WO | 03/063637 | | 8/2003 | |
| WO | WO03063637 | * | 8/2003 | A45C 5/14 |
| WO | WO 03063637 A2 | * | 8/2003 | A45C 5/14 |
| WO | 03/102430 | | 12/2003 | |
| WO | 2006/120509 | | 11/2006 | |

OTHER PUBLICATIONS

Great Britain Search Report Under Section 17 for GB0614145.1 searched Nov. 9, 2007.
Communication pursuant to Article 94(3) EPC for European Patent Application No. 07766221.1 dated Jun. 26, 2018; 7 pages.

* cited by examiner

LUGGAGE CONSTRUCTION

The present application is a continuation of U.S. application Ser. No. 12/373,990, filed Jan. 15, 2009, now U.S. Pat. No. 9,220,326, which is the U.S. national phase of PCT/GB2007/002644, filed Jul. 13, 2007. PCT/GB2007/002644 claims benefit under the Paris Convention to GB 0614145.1, filed Jul. 17, 2006, and GB 0614144.4, filed Jul. 17, 2006. The disclosures of U.S. application Ser. No. 12/373,990, GB 0614145.1, GB 0614144.4, and PCT/GB2007/002644 are hereby incorporated herein by reference.

FIELD OF THE INVENTION

This invention relates to the construction of luggage such as suitcases and/or trolley cases for use by travelers.

Such articles of luggage can conveniently be considered as comprising two major types, the first the so-called "soft" suitcase and the second the so-called "hard" suitcase.

BACKGROUND

Many constructions of suitcases for use by travelers are known. These known constructions of both 'hard' and 'soft' suitcases are of varied form and conventionally include one or two carrying handle arrangements and at least a pair of wheels/rolls for facilitating the movement of the suitcase by a user.

In addition, it is also known to provide cases incorporating a towing handle structure which is usually moveable between a stowed or retracted position and an extended user suitcase towing position.

It is clearly apparent that with the provision of the towing handle facility in conjunction with wheels or rolls the user does not need to have to carry the suitcase. Furthermore in practice the use of the wheels/rolls greatly facilitates the general handling of a suitcase in locations such as crowded airports.

It is convenient to note in relation to the use of the term 'hard' the term is often regarded as applying to those suitcases whose walls, top and bottom cannot be readily pierced by a blade or needle.

Conventionally the so-called 'hard' suitcases incorporate a metal or plastics framework extending around the internal perimeter of the base section of the suitcase that is the load receiving section of the suitcase The framework effectively defines the overall shape and size of the suitcase and to provide structural strength to the suitcase.

The term "soft" can be conveniently regarded as being applied to suitcases that employ a soft outer covering that is supported by an internal framework of metal or appropriate plastics material extending around the total periphery of the top and bottom of the associated suitcase base section in such manner as to define the visual form of the suit case.

In practice, in addition to the provision of such frameworks known soft suitcases can incorporate reinforcements at the top, base and corner sections thereof. Such reinforcements can be formed from plywood, or P. E. Board.

Whatever the actual construction of the "hard" or "soft" suitcases the provision of the towing handle facility has historically involved the provision of at least one pair of tubular members that are additional to the actual structure of the framework of the base section and which are telescopically engageable by the limbs of a U-shaped assembly serving as the actual towing handle.

In practice, the provision of these additional tubes can add significantly to the overall weight of the empty suitcase since additional means has to be provided to mount such tubes to the suitcase framework.

This need to increase the weight of a suitcase can be a inconvenient disadvantage bearing in mind that the major mode of present day travel on a world wide basis is by air, and that as is well known many airline operators are frequently imposing lower and lower limits to the overall weight of the luggage that a traveler is permitted to carry onto an aircraft. In fact, particularly in relation to the most intensively used group of flights, namely the so-called tourist grade whether on scheduled flights or charter flights the allowable weight permitted per passenger is being progressively reduced.

SUMMARY

It is an object of the present invention to provide a case construction incorporating an internal shape providing framework together with a towing handle facility, the construction of which pays attention to the requirement for keeping the empty weight of the case as low as possible whilst maintaining requisite structural strength.

Broadly according to a first aspect of the invention there is provided a suitcase incorporating a base section having an internal framework formed from elongate members interconnected by connection pieces.

In a preferred construction the framework includes a plurality of elongate frame forming members, and eight connection pieces defining the corner regions of the framework, said connection pieces being each adapted to engage with three of said elongate members.

In a preferred construction incorporating a plurality of elongate members including with four defining the length of the suitcase, four defining the width of the suitcase and four defining the depth of the base section of the suitcase, and wherein said construction further includes eight connection pieces for defining corner regions of the framework, each being engageable with three of said elongate members.

In a further preferred construction two of the corner pieces are additionally formed as to provide mountings for wheels/rolls or the like, and two further connection pieces are arranged to provide mounts for suitcase support feet.

In a preferred construction two of the elongate members are hollow and of such dimensions as telescopically to be able to receive the limb members of a U shaped towing handle assembly.

Broadly according to a further aspect of the invention there is provided an article of luggage such as a suitcase incorporating a shape maintaining framework structure, and including a handle assembly/facility incorporated in part of the framework structure.

BRIEF DESCRIPTION OF THE DRAWINGS

For a better understanding of the invention and to show how the same may be carried into effect reference will now be made to the accompanying drawings in which.

DETAILED DESCRIPTION OF THE DRAWINGS

Figure 1:
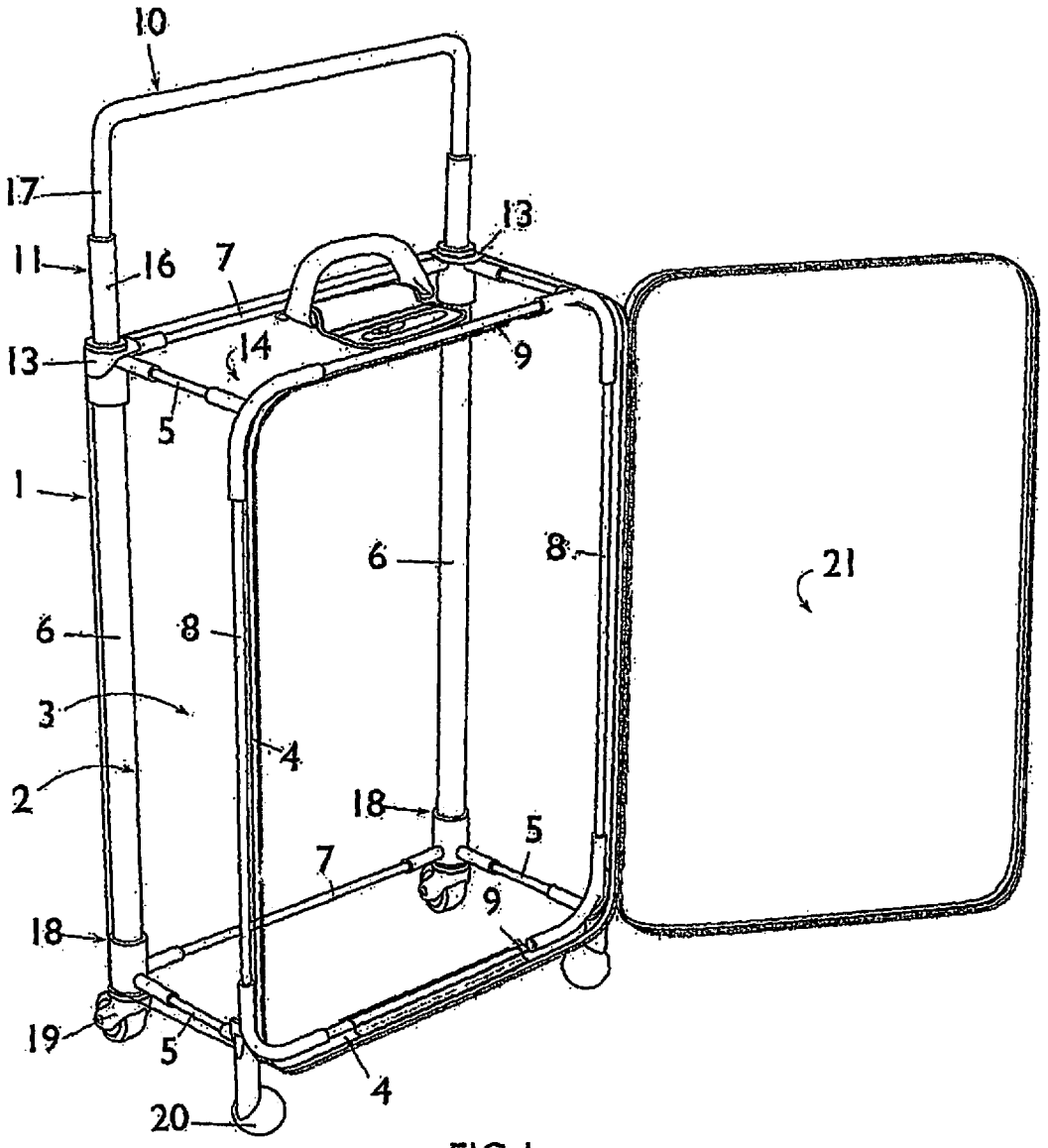
FIG. 1 schematically illustrates a 'soft' suitcase construction incorporating a base section and its supporting framework, a soft outer covering, an associated suitcase closure, and a towing handle assembly/facility.

The suitcase 1 shown in FIG. 1 of the drawing is shown in a vertical standing position with its closure open. As will be seen the suitcase incorporates a framework 2 that can conveniently be regarded as comprising a rectangular base/back frame portion 3, a corresponding rectangular upper/front frame portion 4 and a group of four elongate spacer members 5 for interconnecting the portions 3 and 4 in a required spaced relationship that effectively defines sides and ends and thus the depth of the suitcase 1.

As will be seen from FIG. 1 the base frame section 3 includes two longer side tubular members 6 defining the length of the suitcase, and two shorter members 7 defining the width of the suitcase. The upper frame section 4 similarly includes longer members 8 and shorter members. 9 These members are interconnected by means of connection pieces.

The suitcase incorporates a towing handle facility 10 that makes use of the structure of the base section 3 in that the longer members 6 are utilized in the formation of the towing handle assembly/facility at the top of the suitcase.

The towing handle assembly 10 includes a U frame having parallel limbs 11 spaced by a cross piece 12. The limbs 11 that are telescopically engageable with the longer tubular members 6 of the base section 3.

The operational lengths of the limbs 11 are such that the handle assembly 10 can be retracted/stowed so that the cross bar 12 bears against the adjacent top 14 of the suitcase.

In practice the limbs 11 can comprise a single length of a tube or bar of such length as to enable the cross bar 12 to be positioned at a comfortable user towing setting. This single length limb formation can be particularly used with smaller length suitcases.

In the case of a larger size suitcases the limbs 11 can comprise a double telescopic arrangement (as is in fact shown in the Figures) including an outer tube 16 that is telescopically engageable with the associated elongate member 6, and a smaller diameter tube 17 telescopically engageable with within the first mentioned tube 16.

It will be understood that means (not shown) would be provided for ensuring that the handle assembly does not, when in use disengage from the suitcase base the members 6.

The suitcase is provided with wheels 19, support feet 20 and a closure lid 21.

Figure 2:
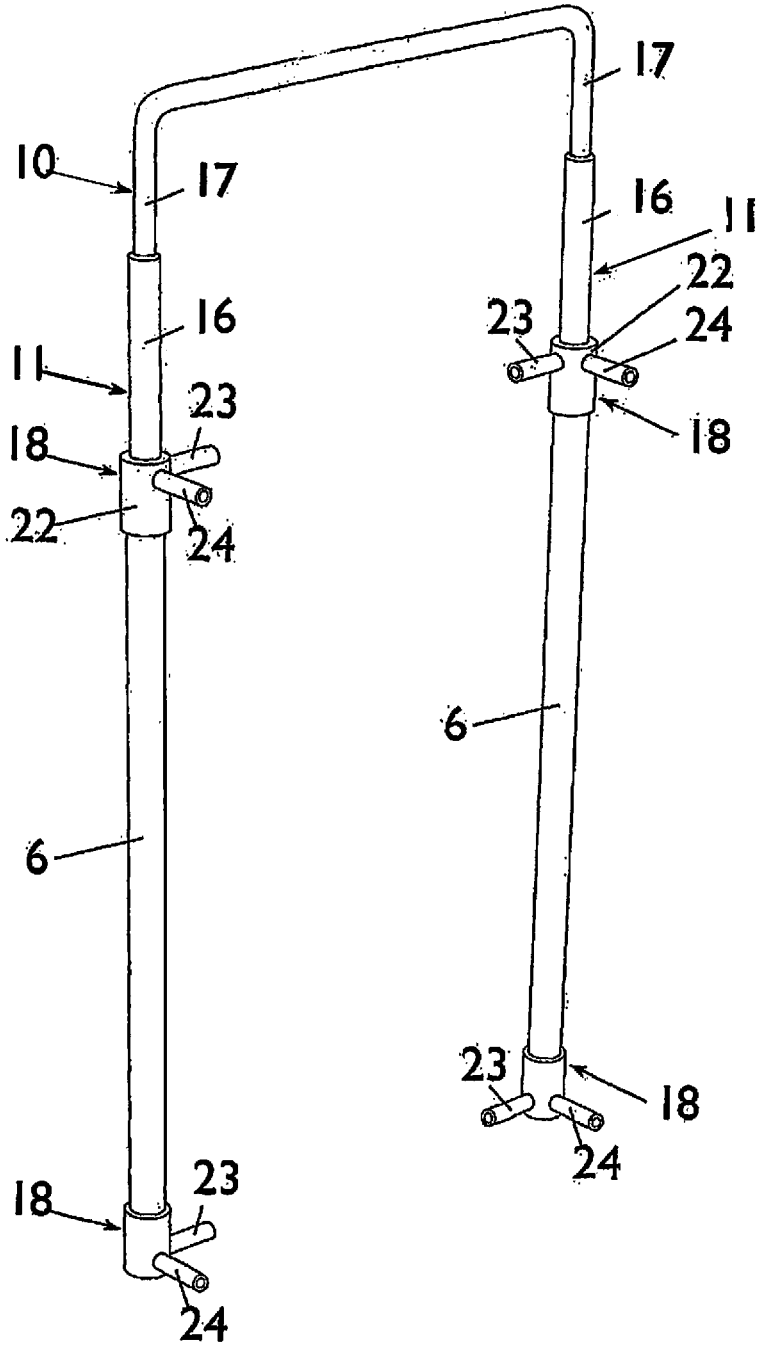
FIG. 2 schematically illustrates to a large scale a more detailed representation of the towing handle assembly/facility of FIG. 1.

The forgoing description in relation to FIGS. 1 and 2 has been essentially concerned with the relationships between the framework 2, the towing handle assembly/facility 10 and its mounting to the base portion 3 of the suitcase framework.

The construction of the framework 2 will now be considered in detail with reference to FIG. 3 that illustrates the suitcase framework in the absence of the suitcase body covering and to later Figures.

As has been mentioned the base portion 3 of the framework includes the elongate members 6 and the cross members that are connected to the members 6 by the connection pieces 18.

Figure 3:
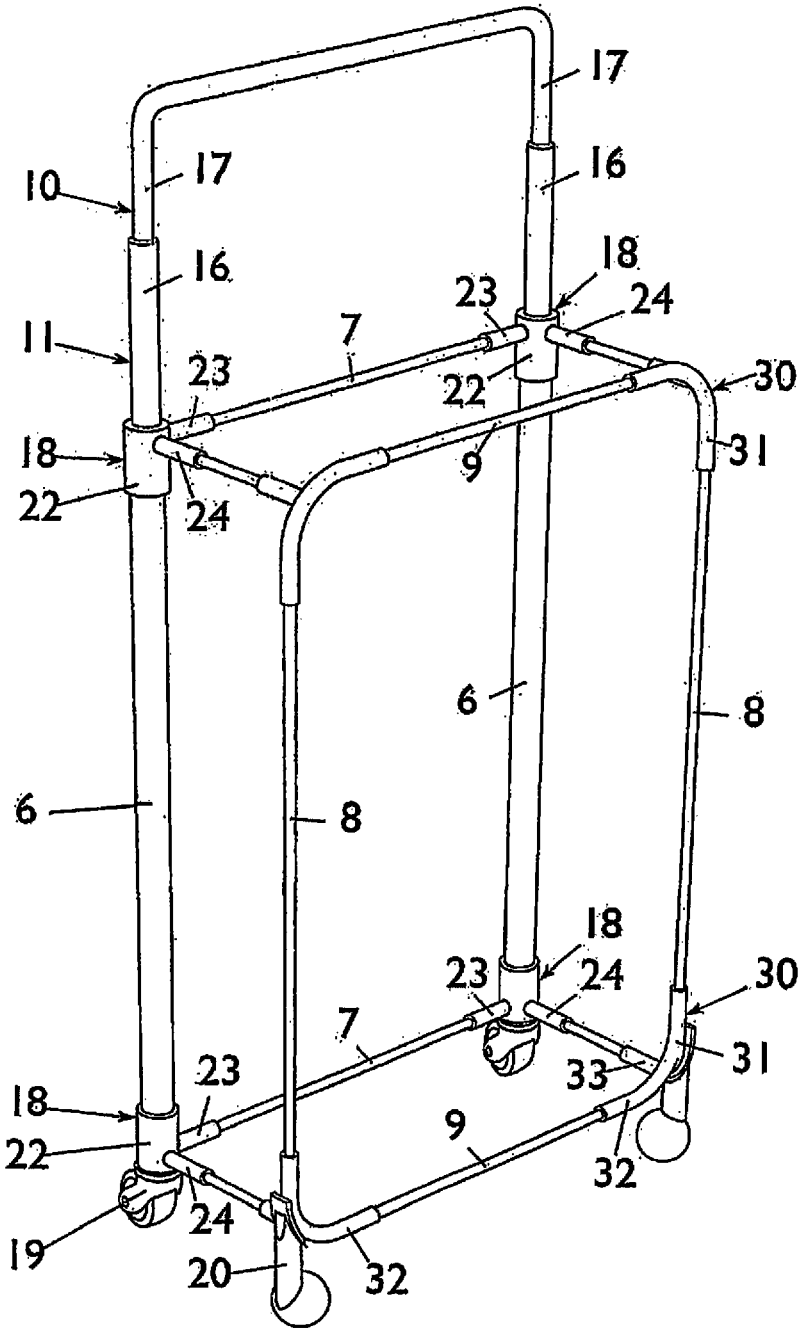
FIG. 3 schematically illustrates the framework of a suitcase incorporating a towing handle assembly/facility.

Thus as may be seen from FIG. 3 each said connection pieces 18 includes a tubular central part 22 that is a firm close fit upon the associated upper and lower end region of the elongate members 6 and two smaller diameter tubular elements 23 and 24 that extend at right angles to each other and also perpendicular to the axial direction of the main body. 22

Since the connection pieces 18 are required to connect with opposite sides of the framework base portion 3 the angular relationships between the main bodies 22 and their associated tubular elements 23 and 24 it is necessary to provide a left hand fitting connection piece and a right hand fitting connection pieces.

In the FIG. 3 it will be noted that the elements 24 are parallel to each other whilst the elements 23 point towards each other.

Each smaller diameter elements 23 is intended telescopically to receive an end of a cross bar, 7 whilst the smaller diameter element 24 is intended telescopically to connect with an end of the member 5.

The upper connection pieces 18 (as shown in the FIGS. 2 and 3) after mounting to the members 6 is open to receive the limbs 11 of the towing assembly/facility 10. It will be understood that the internal diameters of the main body 22, and of the members 23 and 24 will be such as to enable the requisite firmness of secure fit with the elements with which they engage.

The lower connection piece 18 is utilized to provide at the lower end of the main body 22 thereof the connection between the wheels assembly 19 and the base portion 3.

Figure 4:
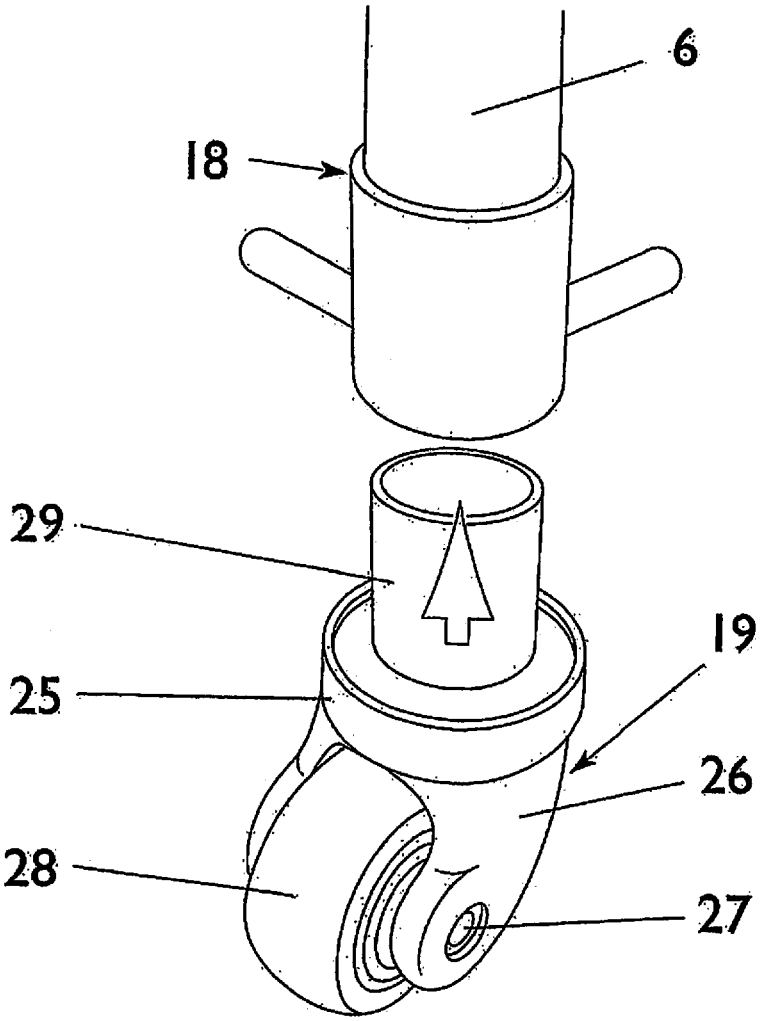
FIG. 4 is a perspective view of a wheel assembly for connection to the framework, the assembly being shown position for attachment to the framework.

Referring now to FIG. 4 this schematically illustrates a wheel assembly 19 having a main part 25 providing a yoke formation 26 for mounting a wheel axial 27 and the wheel 28. The main part 25 and an upstanding stub part 29 that is engageable within the bottom of the main body 22 of the associated connection piece 18. The wheel assembly 19 is secured to the connection piece 18 by any convenient means such as by pinning or by using screws.

It will be noted from the FIGS. 1 and 3 that the front framework portion 4 has rounded/curved corner regions 30 with the result that the connection pieces 31 that interconnect the elements 5, 8 and 9 include left hand and right hand arrangements. In addition since the lower pair of such front connection pieces 31 are utilized to mount support feet 20 for the suitcase case the lower connection pieces 31 are additionally form so as to be able to mount the feet 20.

Figure 5A:
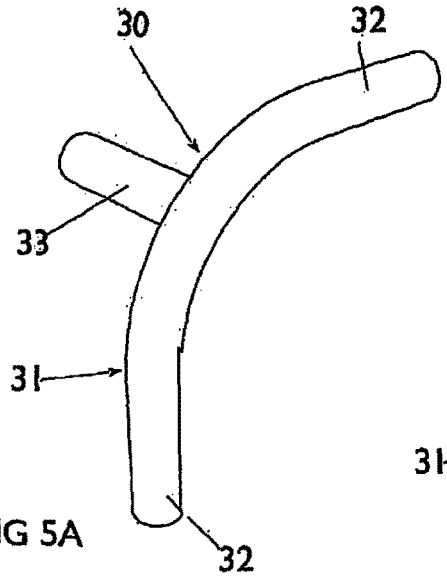
FIGS. 5A and 5B, illustrate in perspective view left hand and right hand fitting connection pieces for the top of the front of the suitcase.
Figure 5B:
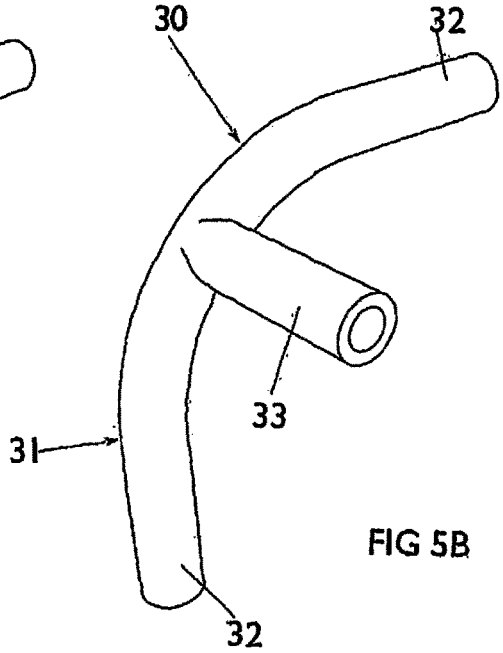

Referring now to FIGS. 5A and 5B these illustrate in perspective view left and right hand versions of the upper connection piece 31. As will be noted this connection piece 31 has a main tubular part of rounded formation forming the rounded/curved corner regions and end regions 32 that are rectilinear. These end regions are intended to receive the respective ends of the elongate bars 8 and 9. That is the main frame members of the front frame portion.

In addition, a tubular member 33 projects at right angles from the mid location of the rounded main portion to enable the engagement with an end of the associated elongate member 5 whose other end connects with a connection piece 18. The relative positions of the tubular members 33 to achieve left and right hand fitting is clearly indicated in the FIG. 3.

Figure 6A:
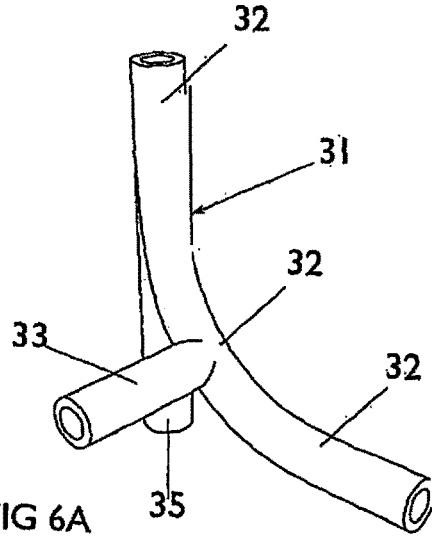
FIGS. 6A and 6B, illustrate in perspective view left hand and right hand fitting connection pieces for the bottom of the front of the suitcase.
Figure 6B:
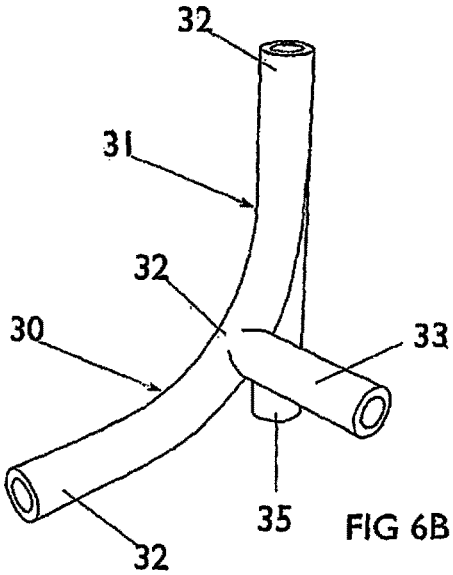

Since a support foot 20 is to be provided at the lower end of each side of the front/upper portion each of the lower front connection pieces 31 is provided with a short tubular extension 35 coaxial with the vertically directed straight length 32 of the rounded main portion as is shown in FIGS. 6A and 6B.

As will be seen from this FIGS. 6A and 6B 5 there is a smooth transition joint between this tubular extension 35 and the reminder of the connection piece 31.

With this arrangement that longitudinal axis of the extension 35 is in line with that of the elongate element 8 when the connection piece 31 is connected thereto.

Figure 7:
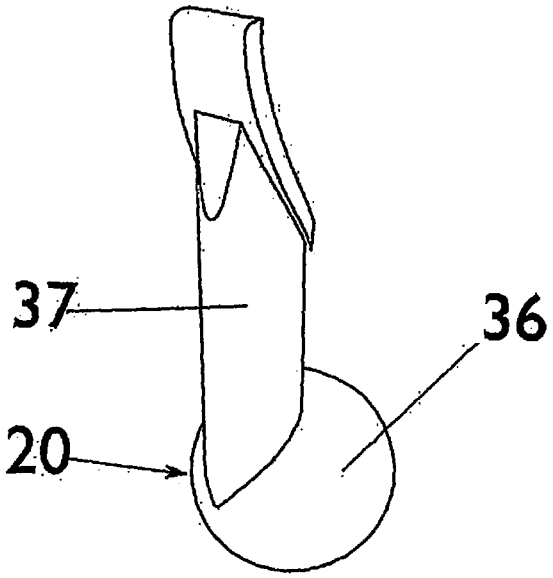
FIG. 7 schematically illustrates in perspective view a foot for the front of the suitcase.

FIG. 7 illustrates a the foot 20 as including a ball like floor engaging part 36 and a tubular part 37 that telescopically receives the above mentioned tubular extension 35.

Figure 8:
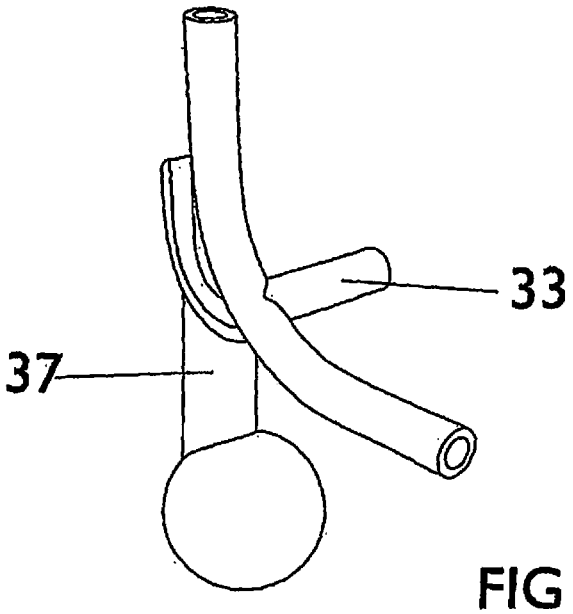
FIG. 8 schematically illustrates in perspective view a foot connected to the a bottom connection piece of the framework of the suitcase.

FIG. 8 illustrates the connection between the foot 20 and its associated connection piece 31.

The foot 20 can be secured to the associated connection piece in any convenient manner such as by using rivets or screws.

The various components of the framework structure, the towing assembly, the wheel assemblies and the feet can be formed from any material(s) considered appropriate namely materials that are of adequate strength in conjunction with lightness of weight. For example the components may be formed from a composite material such as fibre glass/carbon fibre or a plastics material such as NYLON™.

Whilst the above discussion has been specifically concerned with a so-called "soft" type of suitcase the principles of the invention can be utilized in other forms of luggage construction.

For example, the proposals for the back frame portion 3 in conjunction with the towing handle assembly and the associated wheels 18 could be associated with a "fold flat" trolley construction.

The invention claimed is:

1. An article of soft luggage comprising:

an internal shape-defining framework;

a soft outer cover; and a handle having two limbs and a cross piece provided between the two limbs, wherein the internal shape-defining framework comprises:

a plurality of elongate members interconnected to define a shape that is substantially parallelepiped which generally defines a shape of the article of soft luggage, the parallelepiped shape comprising a plurality of corners, each corner defined by the intersection of three faces of the parallelepiped shape; and wherein two of the plurality of elongate members that are provided at corners of the parallelepiped shape of the internal shape defining framework are elongate tubular members which each substantially define a full length of the shape of the article of soft luggage and which are arranged in parallel are each configured to receive a respective limb of the handle so that the handle is moveable in an axial direction between a retracted configuration, in which the limbs are nested within the respective two elongate tubular members, and an extended configuration.

2. An article of soft luggage according to claim 1, wherein the limbs are constructed and arranged in a telescopic arrangement with the respective elongate tubular members.

3. An article of soft luggage according to claim 1, comprising a plurality of connection pieces, wherein the plurality of elongate members are interconnected by the connection pieces.

4. An article of soft luggage according to claim 3, wherein the plurality of connection pieces each have rectilinear or curved corner regions defining a shape of the corners of the article of luggage.

5. An article of soft luggage according to claim 1, wherein the cross piece of the handle extends parallel to a horizontal elongate member.

6. An article of soft luggage according to claim 1, wherein the handle is substantially U shaped.

7. An article of soft luggage according to claim 1, wherein when the handle further comprises a second pair of limbs being telescopically engageable with the first pair of limbs of the handle.

8. An article of soft luggage according to claim 1, further comprising at least two wheels.

9. An article of soft luggage according to claim 8, in which the at least two wheels are positioned beneath the elongate elements receiving the limbs of the handle.

* * * * *